United States Patent [19]

Brashears et al.

[11] Patent Number: 4,530,657

[45] Date of Patent: Jul. 23, 1985

[54] BURNER APPARATUS

[76] Inventors: David F. Brashears; Travis G. Porter, both of 2140 W. Washington St., Orlando, Fla. 32805

[21] Appl. No.: 575,433

[22] Filed: Jan. 31, 1984

[51] Int. Cl.[3] ..... F23M 9/00

[52] U.S. Cl. ..... 431/188; 431/351

[58] Field of Search ..... 432/222, 105; 431/265, 431/351, 187, 188

[56] References Cited

U.S. PATENT DOCUMENTS

| | | | |
|---|---|---|---|
| 2,390,509 | 12/1945 | Carter | 431/265 |
| 3,111,979 | 11/1963 | Peoples | 431/265 |
| 4,230,449 | 10/1980 | Binasik et al. | 431/265 |
| 4,347,052 | 8/1982 | Reed et al. | 431/188 |

*Primary Examiner*—Carroll B. Dority, Jr.

*Attorney, Agent, or Firm*—William M. Hobby, III

[57] ABSTRACT

An industrial burner has a burner housing having a burner head mounted therein and connected to an air pipe. A low pressure high efficiency blower is mounted in the housing adjacent an opening in the housing for drawing air into the burner housing and around the burner head into the combustion chamber. A high pressure turbo blower is located in the housing and connected to draw intake air entering the housing and direct the air under a greater pressure to the burner head through the connecting air pipe and into an industrial dryer. The high pressure blower is driven by an electric motor which also is connected by a belt to a pulley through a portion of the primary air conduit to drive the low pressure blower. The air intake for the housing has air control dampers mounted therein for controlling the flow of the air.

12 Claims, 1 Drawing Figure

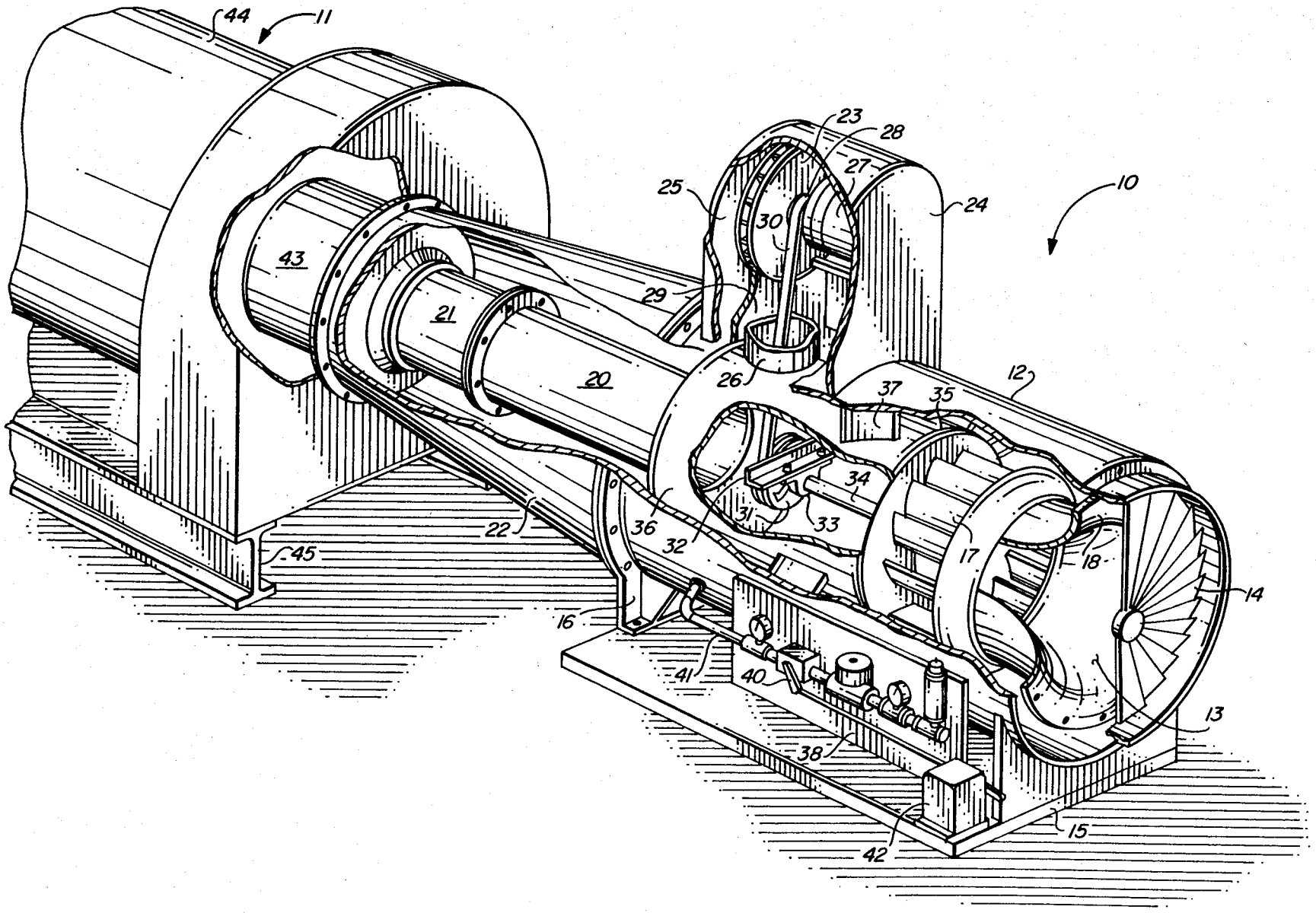
10
11
12
13
14
15
16
17
18
20
21
22
23
24
25
26
27
28
29
30
31
32
33
34
35
36
37
38
40
41
42
43
44
45

BURNER APPARATUS

BACKGROUND OF THE INVENTION

The present invention relates to industrial burners, especially to an industrial burner having high and low pressure blowers interconnected for directing high and low pressure air through different passageways into an industrial dryer.

Large high capacity fuel burners are generally used in industries requiring drying of various materials. For example, such burners are required for operating large rotary aggregate dryers and for kiln drying and processing of lime, bauxite, sand, coal, cement and the like. In the making of asphalt roads, drying units are used for drying the aggregate before mixing with the asphalt.

In drying aggregate, a typical unit may have a rotating horizontal drum in which wet rock is introduced into one end of the drum, carried to the top of the drum, and dropped back. The material is gradually carried to the opposite end of the drum and removed by a conveyor. A fuel burner is typically connected to a combustion chamber placed at one end of the drum. The hot gases and air emanating from the burner are directed through the falling aggregate, known as the aggregate curtain, and serves to dry out all moisture from the material. An exhaust fan at the output end of the drum draws the heat of the air therethrough. The gas temperature at the burning input end may be on the order of 2400 degrees Farenheit, dropping to about 350 at the opposite end of the drum. In large dryers, such as this, the burners are required to produce large amounts of heat on a continuous basis.

In the past, a variety of burner fuels have been utilized but recently burners have tended to use natural gas or fuel oil. The present invention can utilize natural gas, LP, pulverized coal or fuel oil as desired and depending upon the burner head utilized. The absence of certain types of fuels in different parts of the country has resulted in entire manufacturing plants not being able to operate because of the lack of the type of fuel the plant is set up to use. As a result of this, many industrial burners are being designed to use more than one type of fuel and may for instance switch from oil to natural gas as price and availability dictate.

The present invention is for a high efficiency burner using a high pressure turbo blower and a high efficiency, low noise, air flow centrifugal blower for low pressure air and utilizes one air intake into the burner through one set of control dampers for total air control in a simplified burner design. The high pressure and low pressure blowers are interconnected to be driven by a single motor and positioned in a single housing for utilizing air from a single intake into the housing.

SUMMARY OF THE INVENTION

An industrial burner apparatus is adapted to be attached to a rotary dryer and includes a burner housing having an air intake thereinto. A burner head is mounted in the burner housing and a primary air conduit feeds air through the burner head. A low pressure blower is mounted to draw air into the housing through the air intake and to direct air around the burner head and primary air conduit into the combustion chamber. The high pressure air blower is mounted in the housing and connected to draw a portion of the air being drawn into the housing air intake by said low pressure blower and directing the air through the primary air conduit at a higher pressure, and thereby through the burner head so that high pressure air and low pressure air are simultaneously fed to the combustion chamber from a single air inlet. The air inlet can have one set of dampers for total air control for the burner. An electric motor drives the high pressure turbo blower and is connected by a belt through a portion of the primary air conduit to a pulley which in turn is connected to a high efficiency, low noise air foil centrifugal blower for drawing the air into the housing air inlet. A wall formed in the burner isolates the primary air conduit from the low pressure air being drawn into the burner housing.

BRIEF DESCRIPTION OF THE DRAWING

Other objects, features and advantages of the present invention will be apparent from the written description and the drawing in which the drawing is a cutaway perspective view of a burner apparatus in accordance with the present invention connected to a rotary dryer.

DESCRIPTION OF THE PREFERRED EMBODIMENT

Referring to the drawing, an industrial burner 10 can be seen connected to a rotary drum dryer 11 and having a housing 12 having a single air inlet 13 thereinto. The air inlet 13 has a total air control damper 14. The housing 12 is mounted to a support base 15 using support legs 16 and has a high efficiency low noise air foil centrifugal blower 17 mounted just inside the air inlet 13 adjacent a cowling 18 forming a venturi into the blower 17. The housing also has a primary air conduit 20 mounted to a burner head 21. The burner head 21 typically has the fuel nozzle, such as an oil nozzle or a gas head, mounted therein for directing the fuel into the combustion chamber. An igniter may also be mounted thereinto for igniting the fuel. High pressure air is fed into the primary air conduit 20 through the burner head 21 where the fuel is being directed thereinto while low pressure air passes through an annular passageway 22 around the primary air conduit 20 and into the dryer 11. A high pressure turbo blower 23 is mounted in an auxiliary housing portion 24 and has a passageway 25 connected to the annular passageway 22 for drawing air passing around the primary air conduit 20 through the high pressure turbo blower 23 back through the blower of primary air conduit connecting portion 26. The high pressure air is fed into the primary air conduit 26 to produce high pressure air through the burner head from the low pressure air passing around the burner head and primary air conduit 20. Approximate 30% of the air passing thereby will be drawn into the high pressure blower 23 and pressurized for feeding through the primary air conduit 20. A single electric drive motor 27 is mounted in the housing portion 24 and has a direct connection to the high pressure blower 23 and has a belt pulley 28 mounted thereto driving a belt 30 which in turn extends through the top portion 26 of the primary air conduit to drive a pulley 31 mounted to a mounting bracket 32 and supported by a bearing 33 connected to the bracket 32 supporting a blower drive shaft 34. The blower drive shaft is connected to the low pressure blower 17 through an isolating wall 35. Thus a single motor drive is able to drive both blowers in a constant synchronized ratio for producing a predetermined ratio of high pressure air through the primary air conduit to the low pressure air feeding around the burner head into the combustion chamber. The unit can also be equipped with a rotary compressor driven from the same belt and used as the idler pulley for belt tension adjustment. This also allows the use of a single air inlet and a single set of control dampers for controlling the total air input for varying the burner flame by the variations in the dampers and in the speed of the drive motor. The primary air conduit portion 26 is connected to an enlarged primary air plenum portion 36 which in turn is connected to the primary air conduit 20 into the burner head 21. The supporting bracket 32 is connected to the walls of the primary air plenum 36. Primary air plenum 36 is in turn supported by support braces 37 connecting the plenum to the housing 12. Similarly, the funnel shaped cowling is connected to the housing 12 as are the dampers 14. In addition to the air control, a fuel control panel 38 has fuel control valves 40 attached thereto connected to fuel lines 41 for feeding fuel through the housing 12 into the burner head 21 nozzles mounted therein. An inlet fuel line would of course have to be connected to the valves shown on the panel 38 which also shows a pressure gauge and other fuel controls as well as a control box 42 connected to valve 40. The burner head has a flame shield 43 attached thereto to shield the burner head from materials being rotated and dried in the rotating drum 44. The rotary dryer 11 is supported on a base 45.

It should be clear at this point that a simplified industrial burner has been provided which provides total air control through one air inlet into a burner housing having one set of total air control dampers and providing both high pressure air for passing through the burner head and low pressure air for passing the bulk of the air around the burner head into the dryer drum 44 to produce a desired high efficiency burner. However, the present invention is not to be considered as limited to the forms shown which would be considered illustrative rather than restrictive.

I claim:

1. A burner apparatus adapted to be attached to a rotary dryer comprising in combination:

a burner housing having an air intake thereinto;

a burner head mounted in said burner housing;

a primary air conduit connected to said burner head for directing air therethrough;

a low pressure blower mounted to draw air into said housing through said air intake and to direct air around said burner head into a rotary dryer, or the like; and a high pressure blower mounted in an auxiliary housing portion and having an input and an output, the input being operatively coupled to the housing to draw off a portion of the air being drawn into the housing air intake by the low pressure blower and directing the air out the output and through the primary air conduit and to the burner head whereby high pressure air and low pressure air are simultaneously fed to the combustion area of the burner.

2. A burner apparatus in accordance with claim 1 in which said high pressure blower and said low pressure blower are both coupled to a single drive motor shaft to be driven simultaniously by said motor.

3. A burner apparatus in accordance with claim 2 in which said single drive motor is an electric motor driving said high pressure blower and connected by a flexible drive through portion of said primary air conduit to drive the blower drive shaft.

4. The burner apparatus in accordance with claim 3 in which said low pressure blower is mounted to a drive shaft supported in bearings and having a pulley attached thereto connected to flexible drive belt connected to the drive motor.

5. A burner apparatus in accordance with claim 4 in which said high pressure blower is connected through a primary air conduit to a primary air plenum and said primary air plenum is connected through said primary air conduit to the burner head.

6. A burner apparatus in accordance with claim 5 in which said low pressure blower shaft and pulley are mounted to a bracket attached across said primary air plenum walls.

7. A burner apparatus in accordance with claim 5 in which said low pressure blower shaft is connected through a wall in said primary air plenum.

8. A burner apparatus in accordance with claim 7 in which said high pressure blower is a high pressure turbo blower directly connected to said drive motor.

9. A burner apparatus in accordance with claim 8 in which said low pressure blower is a high efficiency, low noise, air foil centrifugal blower.

10. A burner apparatus in accordance with claim 9 in which said burner housing air inlet has an air cowling mounted thereinside extending into the inside of said low pressure blower and forming a venturi from the air inlet in the burner housing.

11. A burner apparatus in accordance with claim 10 in which said primary air plenum is supported by spacing brackets to said burner housing.

12. A burner apparatus in accordance with claim 1 in which a flame shield is mounted over the outlet to the burner of said burner apparatus to protect the burner head from drying materials.

* * * * *